US007389083B2

(12) United States Patent
Sugimoto

(10) Patent No.: US 7,389,083 B2
(45) Date of Patent: Jun. 17, 2008

(54) IMAGE FORMING APPARATUS AND MEDIUM CONVEYING METHOD

(75) Inventor: Shinya Sugimoto, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 272 days.

(21) Appl. No.: 11/008,099

(22) Filed: Dec. 10, 2004

(65) Prior Publication Data

US 2005/0129438 A1 Jun. 16, 2005

(30) Foreign Application Priority Data

Dec. 11, 2003 (JP) ..... 2003-413595

(51) Int. Cl.
*G03G 15/00* (2006.01)
*B65H 7/02* (2006.01)

(52) U.S. Cl. ..... 399/388; 271/264; 271/265.02; 271/270

(58) Field of Classification Search ..... None
See application file for complete search history.

(56) References Cited

U.S. PATENT DOCUMENTS 5,186,449 A * 2/1993 Ohmi et al. ..... 271/10.03
5,575,466 A * 11/1996 Tranquilla ..... 271/10.03

FOREIGN PATENT DOCUMENTS

| | | | |
|---|---|---|---|
| JP | 03238240 A | * | 10/1991 |
| JP | 05004738 A | * | 1/1993 |
| JP | 07315595 A | * | 12/1995 |
| JP | 10181948 A | * | 7/1998 |
| JP | 2002-214964 A | | 7/2002 |
| JP | 2002326741 A | * | 11/2002 |

* cited by examiner

*Primary Examiner*—Daniel J. Colilla
*Assistant Examiner*—'Wynn' Q Ha
(74) *Attorney, Agent, or Firm*—Foley & Lardner LLP

(57) ABSTRACT

An image forming apparatus according to the present invention includes first and second conveying mechanisms disposed at a predetermined distance, a feeding roller for feeding an output medium for supporting a developer image to a predetermined position capable of holding the developer image, a separation roller, or a conveying roller, a cassette for housing the output medium, and a plurality of sensors capable of detecting a time for conveying the output medium between the cassette and the feeding roller and the separation roller or the conveying roller, and is capable of setting its regulating a mount of an applied pressure regulating mechanism based on the detected results of the respective sensors.

15 Claims, 6 Drawing Sheets

IMAGE FORMING APPARATUS AND MEDIUM CONVEYING METHOD

CROSS-REFERENCE TO RELATED APPLICATIONS

This application is based upon and claims the benefit of priority from prior Japanese Patent Application No. 2003-413595, filed Dec. 11, 2003, the entire contents of which are incorporated herein by reference.

BACKGROUND OF THE INVENTION

1. Field of the Invention

The present invention relates to an image forming apparatus such as an electrostatic copying machine, a laser printer and the like. More particularly, the present invention relates to a medium conveying mechanism and a medium conveying method for conveying an output medium.

2. Description of the Related Art

In an electrophotographic copying machine or a printer, a predetermined surface potential is applied to a photosensitive member for holding an electrostatic latent image. The surface potential of the photo-sensitive member corresponding to a background portion or an image portion is selectively changed. Then, a developer image (toner image) obtained by supplying a developer (toner) to its portion is transferred to a material to be transferred (output medium).

The toner image transferred to the output medium is melted by a fixing unit. The toner image is then pressurized, and fixed to the output medium.

Incidentally, as the output medium, various types of media are utilized based on diversification of user's needs. The media are represented by sheets in a wide range of thicknesses from 50 to 250 g/m$^2$, a transparent resin sheet, sealing paper and the like coated with a pressure sensitive adhesive.

Thus, in Japanese Patent Application Laid-Open Publication No. 2002-214964, there has been already proposed an example. In the example, an optimum value of conveying conditions or image forming conditions obtained by outputting a test pattern is stored in advance. The image forming conditions or the conveying conditions are set according to the stored optimum value when image formation based on the corresponding specific conveying conditions or image forming conditions are designated.

However, in the image forming apparatus disclosed in the above-mentioned document, it is disclosed that the degree of gloss of the fixed image is set to a constant level. In this case, the gloss is changed according to the fixing conditions. However, the change of the output image caused by the thickness of the output medium and the number of times by which the image formation was repeated (change with time/ages and wear of the conveying mechanism) and the like is not disclosed.

The type (thickness/material) of the output medium is in a wide range as described above. Accordingly, it is difficult to obtain equivalent reliability and durability for all the output media over a long period of time.

BRIEF SUMMARY OF THE INVENTION

An object of the present invention is to provide an image forming apparatus which can output an image stably irrespective of the number of times of forming an image, to media for outputting having thicknesses and various types and a medium conveying mechanism.

According to an aspect of the present invention, there is provided an image forming apparatus comprising: an image carrier capable of holding a developer image; an output medium housing section capable of housing a medium of an arbitrary size and/or a type for fixing a developer image formed on the image carrier; an output medium guide passage defined from the output a medium housing section to the image carrier for guiding the output medium; a moving mechanism provided at an arbitrary position of the output medium guide passage to provide a thrust force for moving the output medium from the output medium housing section to the image carrier; a speed detecting mechanism for detecting the speed of the output medium moving in the output medium guide passage; and a speed changing mechanism for changing a pressure provided for the output medium from the moving means when the change of the speed of the output medium is detected by the speed detecting means to change the speed by which the output medium is moved.

According to an other aspect of the present invention, there is provided an image forming apparatus comprising: a medium conveying mechanism, having at least one of roller member which rotates by a motor member, for conveying the medium to be transferred; a medium speed detecting unit for detecting the conveying speed of the medium to be transferred; and a pressure changing unit for changing the pressure provided for the medium to be transferred by the medium conveying mechanism in response to a difference from a predetermined speed that the medium to be transferred is conveyed to fall within a predetermined range if a difference between the speed of the medium to be transferred detected by the medium speed detecting unit and a predetermined speed that the medium to be transferred is conveyed is larger than a predetermined value.

According to a further another aspect of the present invention, there is provided a medium conveying method comprising: feeding an output medium for supporting a developer image developed by developing means to a transfer position to which the developer image is transferred to the output medium, detecting the time for conveying the output medium between housing means and the transfer position, obtaining a regulating amount that a pressurizing force supplied to the output medium is regulated in a feeding mechanism for feeding the output medium to the transfer position based on the detected result, and regulating the pressurizing force to be supplied for the output medium from the feeding mechanism according to the obtained regulating amount.

According to a still further another aspect of the present invention, there is provided an image forming apparatus comprising: a medium conveying mechanism, having at least one of roller member which rotates by a motor member, for conveying the medium to be transferred; a medium speed detecting unit for detecting the conveying speed of the medium to be transferred; and a medium conveying speed changing unit for changing the conveying speed provided for the medium to be transferred by the medium conveying mechanism in response to a difference from a predetermined speed that the medium to be transferred is conveyed to fall within a predetermined range if a difference between the speed of the medium to be transferred detected by the medium speed detecting unit and a predetermined speed that the medium to be transferred is conveyed is larger than a predetermined value.

According to a still further another aspect of the present invention, there is provided an image forming apparatus comprising: a medium conveying mechanism, having at least one of roller member which rotates by a motor member, for conveying the medium-to-be transferred; a medium conveying timing control section for controlling a timing of conveying the medium to be transferred; a medium speed detecting unit for detecting the conveying speed of the medium to be transferred; and a timing changing unit for changing the timing of conveying the medium to be transferred by the medium conveying mechanism in response to a difference from a predetermined speed that the medium to be transferred is conveyed to fall within a predetermined range if a difference between the speed of the medium to be transferred detected by the medium speed detecting unit and a predetermined speed that the medium to be transferred is conveyed is larger than a predetermined value.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principle of the invention.

DETAILED DESCRIPTION OF THE INVENTION

Preferred embodiments of the present invention will be described by referring to the accompanying drawings.

Figure 1:
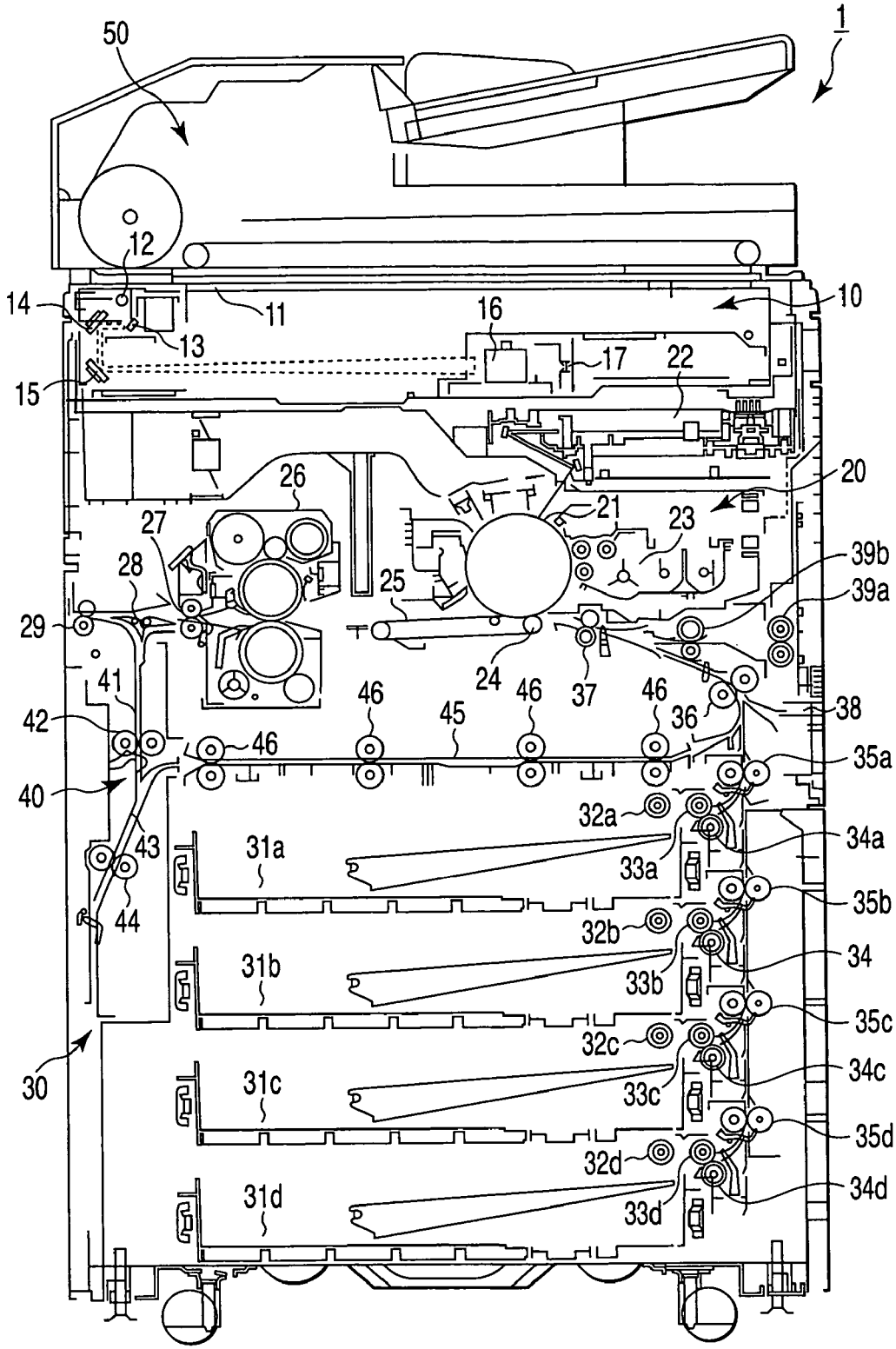
FIG. 1 is a schematic view for explaining an example of an image forming apparatus to which an embodiment of the present invention is applied.

FIG. 1 shows an example of an image forming apparatus to which an embodiment of the present invention is applied.

As shown in FIG. 1, the image forming apparatus 1 has an image reading section 10, an image forming section 20, a sheet supply section 30 and an automatic document feeder (ADF) 50.

The image reading section 10 captures image information of an object to be copied (read) as contrast of light. The image reading section 10 thus outputs a signal corresponding to the image information, that is, image data. More particularly, the image reading section 10 includes a document table 11 for holding the object to be copied (read) (not shown), a lighting unit 12 for illuminating the object set to the document table 11, first to third mirrors 13, 14 and 15 for sequentially guiding reflected light, that is, image light from the object illuminated by the lighting unit 12 toward a CCD sensor of subsequent stage, a lens 16 for imparting a predetermined imaging magnification to the image light guided by the mirrors 13 to 15, and a CCD sensor 17 for receiving the image light given by the predetermined imaging magnification via the lens 16 to output image data corresponding to the image light, and the like.

The image forming section 20 forms a copy image, that is, an output image based on the image data generated by the image reading section 10. More particularly, the image forming section 20 includes a photosensitive member 21 for holding an electrostatic image generated by illuminating with light the photosensitive member 21 in a previously charged state, an exposure unit 22 for illuminating light having an intensity distribution corresponding to the image data on the photosensitive member 21, a developing unit 23 for selectively supplying a developer (toner) to a latent image formed on the photosensitive member 21, a transfer unit 24 for transferring a developer image, that is, a toner image on the photosensitive member 21 to an output medium represented by a sheet or a resin sheet or the like supplied from a sheet supply section 30 at predetermined timing, a conveying unit 25 for conveying the output medium to which the toner image is transferred, and a fixing unit 26 for securing (fixing) the toner to the output medium conveyed by the conveying unit 25. Incidentally, the output medium to which the toner image (individual toner particles) is fixed via the fixing unit 26 is guided, though not described in detail, to a predetermined feeding passage (path), which will be described as below. The output medium is guided by a discharging roller 27 and a switching unit 28 disposed at the output side of the fixing unit 26, in response to an image formation mode, such as, for example, image formation on both surfaces of the output medium. For example, the output medium discharged out of the image forming apparatus 1 is guided from the switching unit 28 to a discharging roller 29. If the image formation on both surfaces is designated, the output medium is guided from the switching unit 28 to the reversing section 40 which will be described in the following.

The output medium is supplied from the sheet supply section 30 to the image forming section 20. More particularly, the sheet supply section 30 includes sheet holding units and sheet conveying units. The first to fourth cassettes 31*a* to 31*d* are capable of housing sheets (output media) of arbitrary sizes. First to fourth pickup rollers 32*a* to 32*d* feed the sheets housed in the respective cassettes mounted in the respective slots toward conveying passages which will be described below. First to fourth sheet feeding rollers 33*a* to 33*d* separate the sheets fed by the first to fourth pickup rollers 32*a* to 32*d* one by one in response to a difference of frictional forces and separation rollers 34*a* to 34*d* contacted with the individual sheet feeding rollers. The sheet conveying units respectively supply the sheet fed from the arbitrary cassette toward the image forming section 20. The sheet conveying units respectively include conveying rollers 35*a* to 35*d* for conveying the sheet fed from the arbitrary cassette (slot) via the corresponding pickup rollers 32 (32*a* to 32*d*), sheet feeding rollers 33 (33*a* to 33*d*) and separation rollers 34 (34*a* to 34*d*) toward the image forming section 20, an intermediate conveying roller 36 provided between the conveying roller 35*a* disposed at the position nearest to the photosensitive member 21 and the photosensitive member 21 and an aligning roller 37 provided directly before the photosensitive member 21 and the like. The sheet conveying unit conveys the sheet of a predetermined size from the arbitrary slot (cassette) toward the aligning roller 37 so as to be able to hold the toner image formed on the photosensitive member 21 by the image forming section 20.

The sheet conveying section also includes a gate 38 capable of guiding the sheet supplied from a large capacity sheet feeder (not shown) capable of housing 2,000 to 3,000 of sheets to the aligning roller 37, and manual feeding rollers 39*a*, 39*b*, etc. capable of guiding the sheet set to a multi-purpose feeder (manual feeding unit) (not shown) to the aligning roller 37.

The reversing section 40 includes reversing guide passage 41 for guiding the sheet through the switching unit 28 to guide the sheet fixed with the toner image by the fixing unit 26 when the image is again formed on the back surface of the sheet (output medium) transferred with the toner image by the image forming section 20 again to the aligning roller 37 in the state that the toner-image-transferred surface is reversed front surface side to the back surface side, so that it can be again contacted with the photosensitive member 21. The section 40 also includes a reversing housing roller 42 for feeding the sheet guided to the reversing guide passage 41 to a reversing housing unit 43, a housing unit discharge roller 44 for feeding the sheet housed in the reversing housing unit 43 to the image forming section 20, a reversing passage 45 for guiding the sheet directed from the reversing housing unit 43 toward the image forming section 20, and a plurality of reversing and conveying rollers 46 for conveying the sheet conveyed in the reversing passage 45 toward the aligning roller 37 (which may be fed to the intermediate conveying roller 36 in FIG. 1) and the like.

The ADF 50 replaces an object to be copied at each generation of image data by the image forming section 10 and each image output by the image forming section 20 when the object to be copied is a sheet state.

In the image forming apparatus 1 shown in FIG. 1, when the object to be copied (hereinafter referred to as a "document") is set via the ADF 50 or directly to the document table 11. When the formation of the image is designated, an illuminated light is radiated from the lighting unit 12 at predetermined timing, the document is illuminated.

The reflected light (hereinafter referred to as image light) from the document is guided to the lens 16 via the first to third mirrors 13 to 15. A predetermined imaging magnification is imparted by the lens 16, and the image light is imaged on the CCD sensor 17.

The image light imaged on the CCD sensor 17 is photoelectrically converted by the CCD sensor, converted to image data by an image processing unit (not shown), and stored in an image memory (not shown).

A predetermined potential is applied to the surface of the photosensitive member 21 by a charging unit (not described in detail) at predetermined timing to the start of illuminating the document by the lighting unit 12.

Thus, exposure light changing in intensity based on the image data from the exposure unit 22 is illuminated (exposed). In this manner, the potential of the photosensitive member 21 to which the predetermined potential is applied is selectively changed. Its potential difference is held as a latent image on the photosensitive member 21.

The latent image held on the photosensitive member 21 is developed (visualized) by selectively supplying the developer, that is, the toner from the developing unit 23 to the photosensitive member 21.

The toner image formed on the photosensitive member 21 is transferred by the transfer unit 24 to the output medium (sheet, resin sheet or the like) guided at predetermined timing previously to the aligning rollers 37. Then, the toner image is conveyed toward the fixing unit 26 by the conveying unit (belt) 25.

The toner image guided to the fixing unit 26 is heated together with the output medium by the fixing unit 26, melted, and secured (fixed) to the output medium by providing a predetermined pressure.

Incidentally, as the output medium, as described above, there are various types represented by the sheets in a wide range of thicknesses from 50 to 250 g/m$^2$, the transparent resin sheet, the sealing paper coated with a pressure sensitive adhesive.

Therefore, when the image forming apparatus is delivered by shipment, the medium of an arbitrary type is represented, and the rotating speed and pressure of the roller are set.

However, from various reasons if the type or the material of the sheet used in the highest frequency by a user are different from those of the sheet utilized to be regulated when the image forming apparatus is delivered from a factory by shipment, or if the sheet used to regulate at a factory delivering time is difficult to be acquired, such a case might occur in which a sheet supplying and conveying capability should be regulated at any or all of the sheet supply section, the sheet conveying section and the reversing section.

Incidentally, as the examples of the controlling conditions, there are, for example, as below:

a) The conveying force of the pickup roller is regulated by the pressurizing force of the pickup roller.
b) The separating force is regulated by the pressurizing force of the separation roller.
c) The speed of the sheet feeding roller is regulated by the rotational speed of a motor for the sheet feeding roller.
d) Sheet interval regulated by the timing for feeding the sheet (firmware processing).
e) Conveying force of the conveying roller is regulated by the pressurizing force of the conveying roller.
f) Aligning time is regulated by the aligning time by the aligning roller (firmware processing).
g) Speed of conveying roller is regulated by the rotational speed of the motor for the conveying roller.

Actually, at a machine body setting (delivering and initializing) time or if the using sheet is changed and the like, the using sheet is test copied. Then, the passing times between the respective sensors at the sheet supply and conveying times are measured. The items of a) to g) are regulated based on the result.

Figure 2:
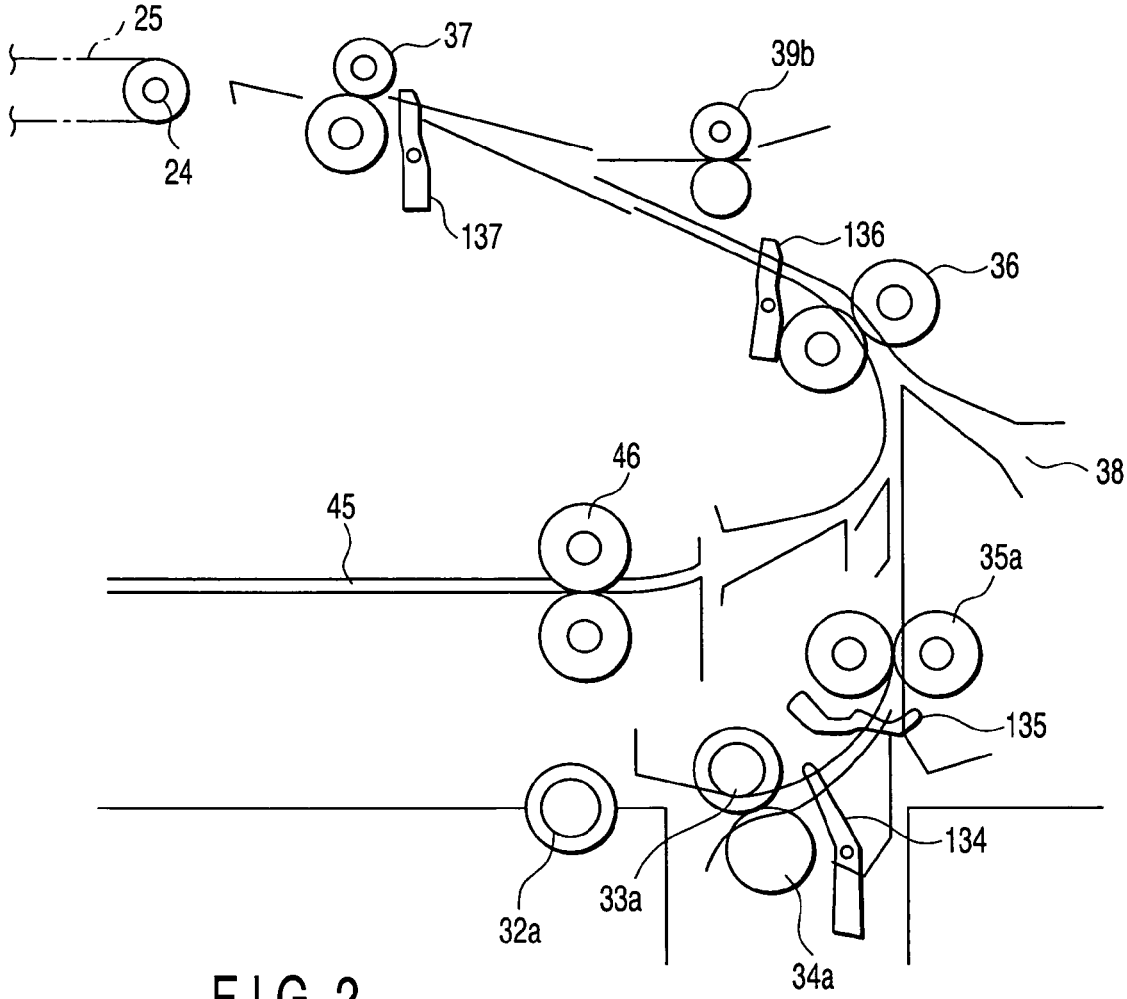
FIG. 2 is a schematic view for explaining the relation between an object to be controlled (roller) and a sensor position in the image forming apparatus shown in FIG. 1.

FIG. 2 explains the relationship between the above-mentioned object to be controlled (rollers and the like) and the sensor positions. In FIG. 2, the state that parts of the sheet supply section and the sheet conveying section are extracted is shown. It should be noted that the rollers and the sensors of the similar structure may be provided at predetermined positions of the sheet supply section, the sheet conveying section and the reversing section.

As shown in FIG. 2, the sheet fed by the pickup roller 32*a* from the slot (cassette) 31*a* is separated to one sheet by the sheet feeding roller 33*a* and the separation roller 34*a*. The sheet is then passed through a separation sensor 134 and a conveyance sensor 135, and guided to conveying rollers 35*a*. Though not described in detail, an empty sensor for sensing the presence or absence of the remaining sheet in the cassette 31*a* is provided at a predetermined position of the cassette 31*a*.

The sheet guided by the conveying rollers 35*a* is guided to the intermediate conveying rollers 36, sequentially passed through an intermediate conveying sensor 136 and an aligning sensor 137, and guided to the aligning rollers 37.

The gate 38 for combining the sheet from a large capacity feeder (not shown) to the conveying passage, and a passage for combining the sheet conveyed along the reversing passage 45 and advanced by the reversing and conveying rollers 46 to the conveying passage are provided before the intermediate conveying rollers 36. Incidentally, the manual feeding rollers 39*a*, 39*b* for guiding the sheet from the multipurpose feeder (not shown) are provided before the aligning sensor 137.

Figure 3:
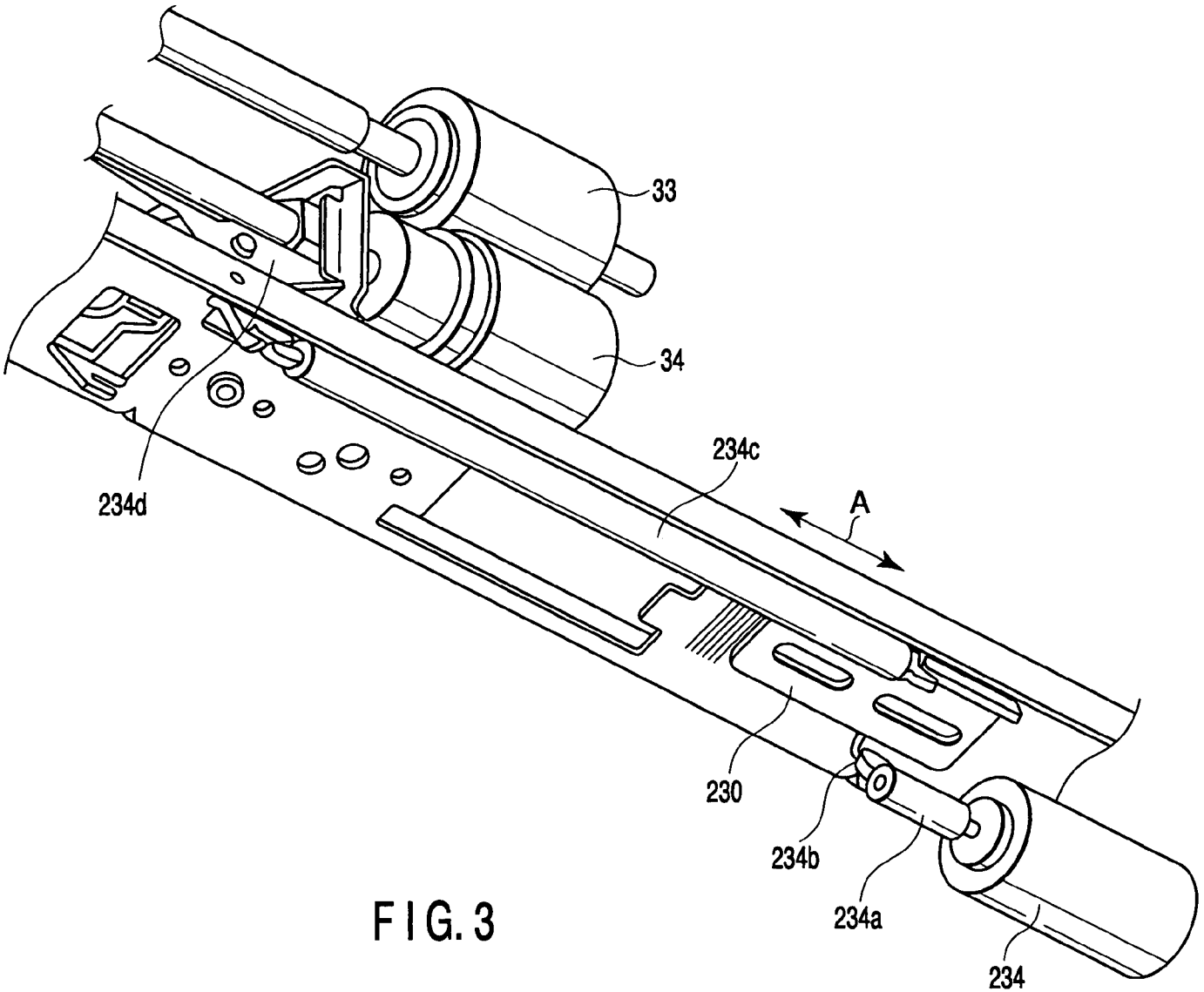
FIG. 3 is a schematic view for explaining a pressurizing force regulating mechanism which can change a pressurizing force between a sheet feeding roller and a separation roller described in FIG. 2.

FIG. 3 is a schematic view for explaining the pressure (applied pressure) regulating mechanism capable of changing the pressure acting on between the sheet feeding rollers and the separation roller described by using FIG. 2. In the image forming apparatus shown in FIG. 1, four sets of the sheet feeding rollers (33) and the separation rollers (34) are used. However, in FIG. 3, an arbitrary one set will be described representatively. It should be noted that the structure explained by using FIG. 3 may also be applied to four sets of the conveying rollers (35), the intermediate conveying rollers 36, the reversing and housing rollers 42, the housing unit discharging roller 44, and the reversing and conveying rollers 46. Here, reference characters (mn) denote that there are a plurality of rollers of the same structure, which are disposed at arbitrary positions.

As shown in FIG. 3, an applied pressure regulating mechanism 230 includes, for example, a motor 234 provided at a predetermined position of a guide plate (no reference numeral), a worm gear 234*a* fixed to the shaft of the motor 234, a rack 234*b* engaged with the worm gear 234*a* and movable in a direction of arrows A, a spring 234*c* capable of changing a tensile force in response to the moving distance of the rack 234*b*, and a lever 234*d* for pressurizing the separation roller 34 to the sheet feeding roller 33 by the tensile force of the spring 234*c*.

Therefore, the motor 234 is rotated, for example, in a first direction. Then, the rack 234*b* is moved in a direction for extending the spring 234*c*. When the motor 234 is rotated in a second direction reverse to the first direction, the rack 234*b* is moved in a direction for contracting the spring 234*c*. Thus, the applied pressure of the separation roller 34 to the sheet feeding roller 33 is arbitrarily set.

Figure 4:
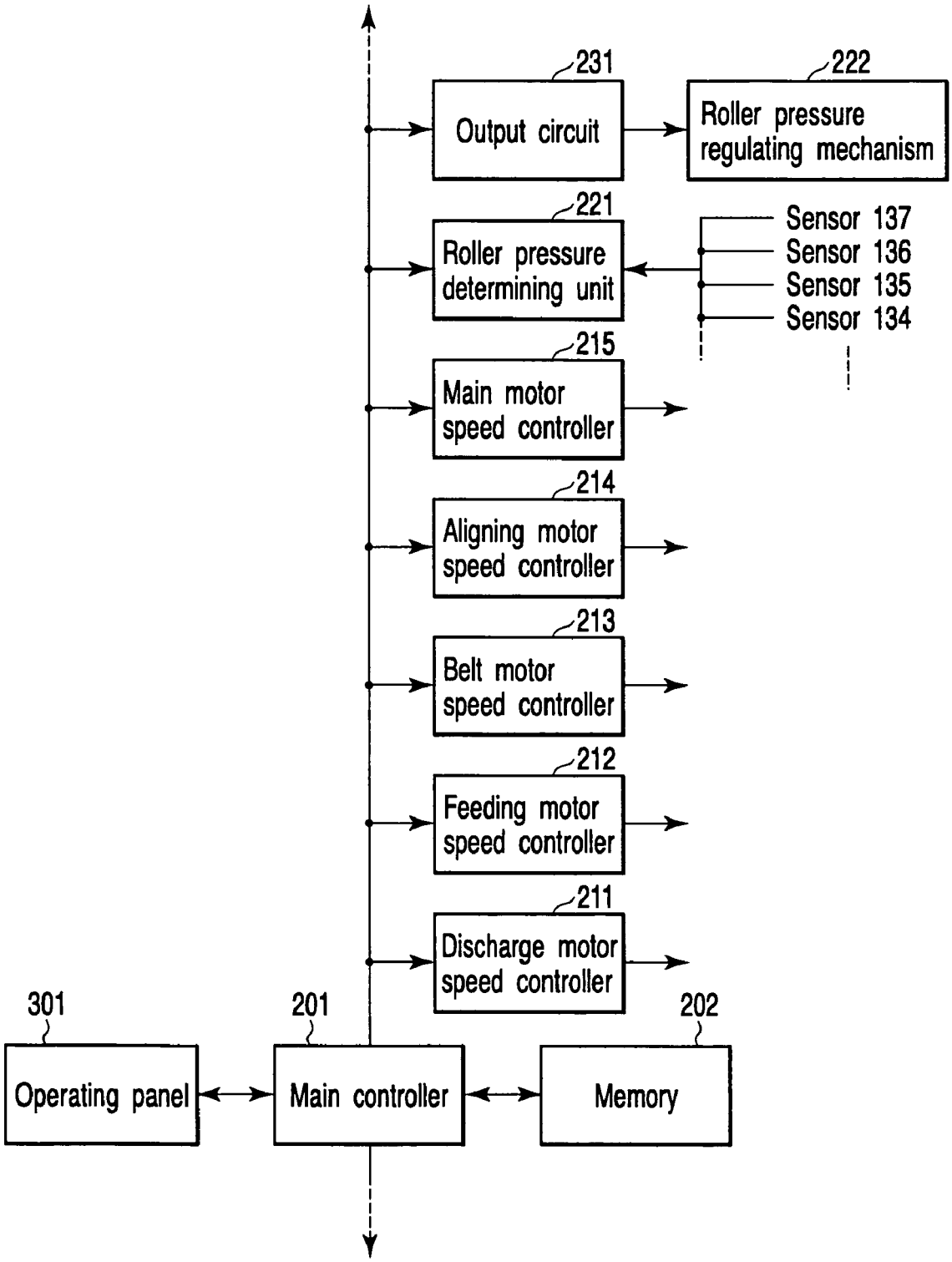
FIG. 4 is a schematic block diagram showing an example of the pressurizing force regulating mechanism explained by using FIG. 3 and a control system which can change the rotating speeds of respective rollers.

FIG. 4 is a block diagram for simply explaining an example of a roller applied pressure regulating mechanism and a control system capable of changing the rotating speed of the roller described by using FIG. 3.

AS shown in FIG. 4, the outputs from the separation sensor 134, the conveyance sensor 135, the intermediate conveying sensor 136 and the aligning sensor 137 explained by using FIG. 2 are inputted to a roller pressure determining unit 221 via an input circuit (A-D converter) (not shown). Incidentally, for example, in this example, the roller pressure determining unit 221 is independently provided. However, it should be noted that the roller pressure determining unit 221 may be prepared as a firmware of a main controller (MPU) 201.

Signals from the respective sensors are utilized to calculate the sheet passing time between the respective sensors by the roller pressure determining unit 221 or the MPU 201.

For example, the following times are obtained by the MPU 201:

1) A time of starting rotation (starting feeding of the sheet) of the pickup roller (32) to the separation sensor (134) →→the speed of the pickup roller (32).
2) A time from the separation sensor (134) to the conveyance sensor (135)→→the speed of the sheet feeding roller (33).
3) A time from the conveyance sensor (135) to the intermediate conveying sensor 136→→the speed of the conveying roller (35).
4) A time from the intermediate conveying sensor 136 to the aligning sensor 137→→the speed of the intermediate conveying roller 36.

Reference characters (mn) show that there are a plurality of the rollers or the sensors of the same structures, and show the roller or the sensor at an arbitrary position.

The speeds of the rollers calculated based on the outputs of the respective sensors are compared, for example, with the reference previously stored in a memory 202. If the speed of the sensor is delayed, a predetermined signal is outputted from an output circuit 231 to the roller pressure regulating mechanism 222 so as to raise the applied pressure of the roller. That is, as described above by FIG. 3, the rack 234*b* is moved in a direction for elongating the spring 234*c*.

Incidentally, from the time of starting of the sheet feeding (starting the rotating of the pickup roller) to the aligning sensor, the sheet feeding time of one sheet is obtained.

That is, the delay (slipping) of the sheet feeding time means that copying time per one sheet becomes long. It shows that predetermined number of image outputs per predetermined time cannot be performed (there is possibility of not satisfying the specification). Therefore, the timing of starting the rotation of the pickup roller is, for example, shortened so as to shorten an interval between the preferentially conveyed sheet and the subsequently conveyed sheet.

The corresponding speed of the motor is arbitrarily set to a predetermined speed by a main motor speed controller 215, an aligning motor speed controller 214, a belt motor speed controller 213, a feeding motor speed controller 212 and a discharge motor speed controller 211 shown in FIG. 4.

Incidentally, the delay of the above-mentioned sheet feeding time is theoretically eliminated by accelerating the conveying speed of the delayed part. However, it possibly complicates the speed controls of individual motors to accelerate the conveying speed of the sheet only at the specific part. Further, it should eliminate the delay of the sheet conveying speed by gradually accelerating the speed of the motor, for example, in response to the wear (the accumulation of the number of times of forming the image) of the roller and the like. However, the speed of accelerating the motor by about 20% causes a new problem, such as the power consumption of the motor to be increased or a noise to be brought about.

From such a focus, it is considered to adopt a regulating mode for regulating, for example, the speed of conveying the sheet (transfer medium) so as to eliminate the slipping of the sheet by increasing the applied pressure provided for the sheet and raising the conveying power provided for the sheet, prior to the change of the sheet conveying speed when the sheet is conveyed.

For example, if the speed of conveying, that is, the conveying speed of the conveyed sheet of arbitrary size and type is regulated, a predetermined regulating mode is selected from the regulating mode setting screen (not shown), and the selected regulating mode is performed.

When an example of the regulating mode is shown, "a regulating mode" is, for example, set corresponding to a predetermined operation (setting of the operation mode).

When the "regulating mode" is performed, the time when the sheet is passed between arbitrary sensors (or selected sensors according to a predetermined routine) is measured based on an output signal from each sensor described by using FIG. 2 and FIG. 4, and the presence or absence of the conveying unevenness of the conveyed sheet is sensed. Incidentally, it is noted that the "regulating mode" may be, for example, automatically started according to a preset timing (the number of times of forming the image). Further, the regulating mode can be operated (set) under various conditions, for example, each time a power source of the apparatus is turned on at the time of setting up the image forming apparatus or at the time of normal operation, or at resetting mode time or from a paper jam (JAM) or the like, in addition to the specific timing.

In the "regulating mode", when the conveying unevenness of the sheet conveyed at present is detected, a pressure between the arbitrary rollers (or selected roller according to a predetermined routine) is set (changed) by the MPU 201 or the roller pressure determining unit 221 explained by using FIG. 4. Incidentally, if the magnitude of the detected conveying unevenness falls within a predetermined range, the normal operation is continued. Even if the magnitude of the detected conveying unevenness falls within the predetermined range, the regulating mode may be forcibly performed by a personnel for, for example, a service.

Figure 5:
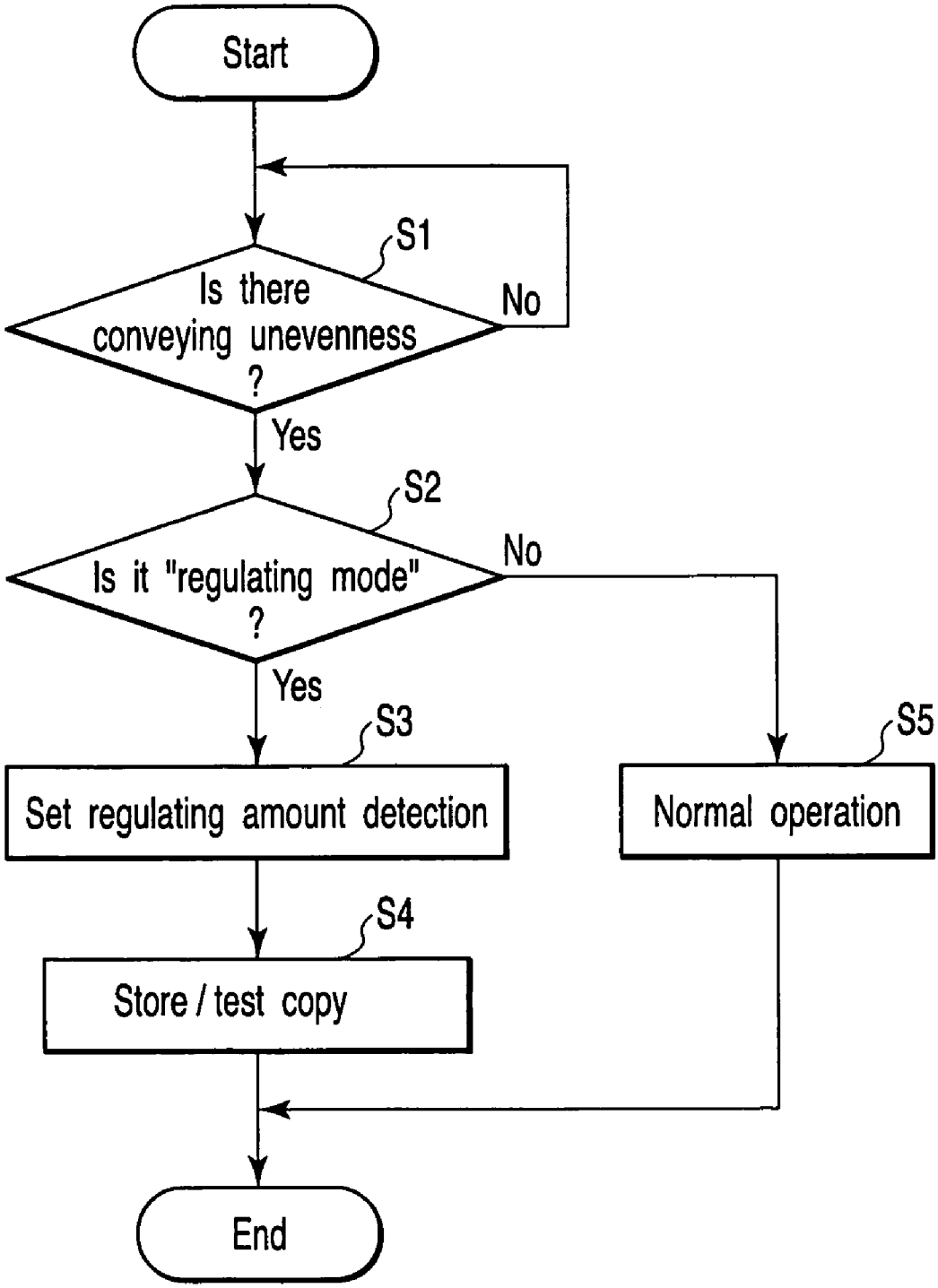
FIG. 5 is a flowchart for explaining an example of the regulating step of regulating a conveying speed of a sheet explained by using FIGS. 2 and 3.

Further, as will be described, for example, by using FIG. 5, the speed fault of the sheet conveying is always monitored. It is needless to say that the "regulating mode" may be performed as needed in accordance with its result.

In this case, at the time point (S1) when the occurrence of the conveying unevenness is detected based on the detected result of the conveying speed of the sheet, for example, by the respective sensors, whether the regulating mode is performed or not is selected. If the performance of the regulating mode is selected (YES in S2), the applied pressure between arbitrary rollers is set by the MPU 201 or the roller pressure determining unit 221 based on the time when the sheet is passed between the sensors obtained based on the signals from the respective sensors (S3).

In step S3, when the applied pressure is set (changed) between arbitrary rollers, the pressurizing force is stored related to the type and the number of sheets in the memory 202 (S4).

Incidentally, if the magnitude of the conveying unevenness is smaller than a predetermined magnitude, or if the regulating mode is not selected, a normal operation is maintained (S5).

Actually, the following operation will be, for example, performed.

Figure 6A:
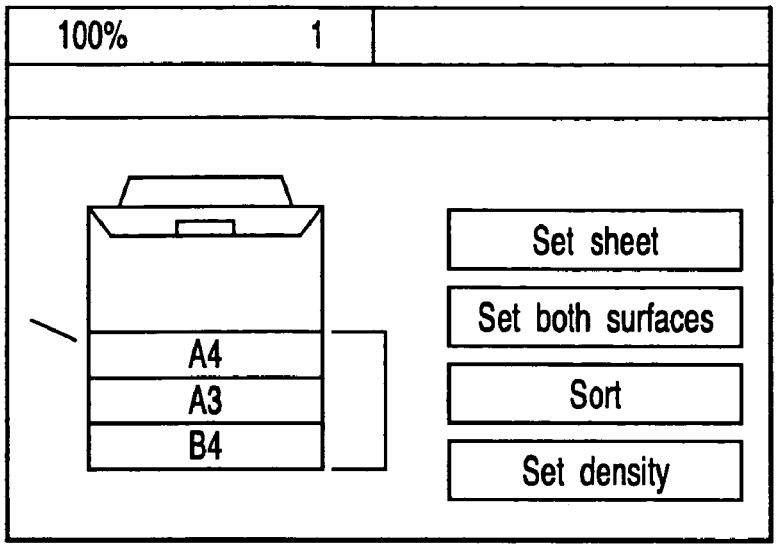
FIGS. 6A to 6C are schematic views for explaining an example of displaying an operating panel which can be utilized for the step of regulating the conveying speed of the sheet described by using FIGS. 2, 3 and 5.

If the user, for example, changes the type of the sheet, in the display as shown in FIG. 6A by the operating panel 301, sheet setting is selected by "sheet setting" display by an operation screen (touch panel) as shown in FIG. 6A.

Figure 6B:
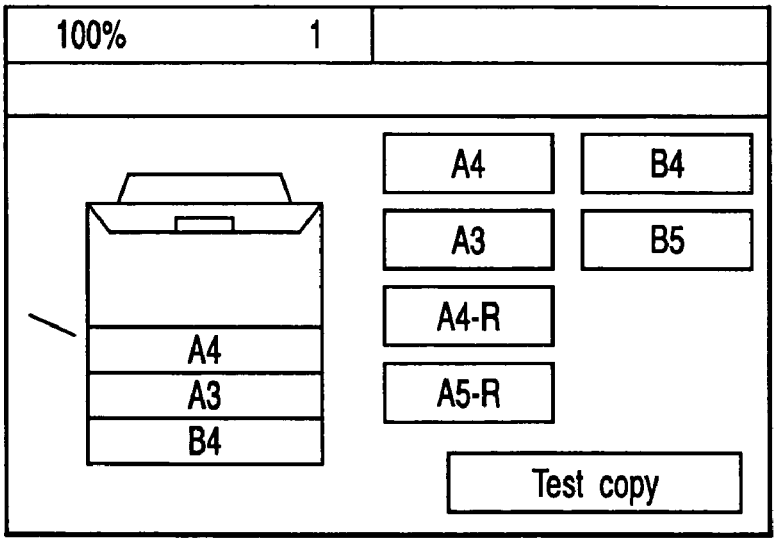
Figure 6C:
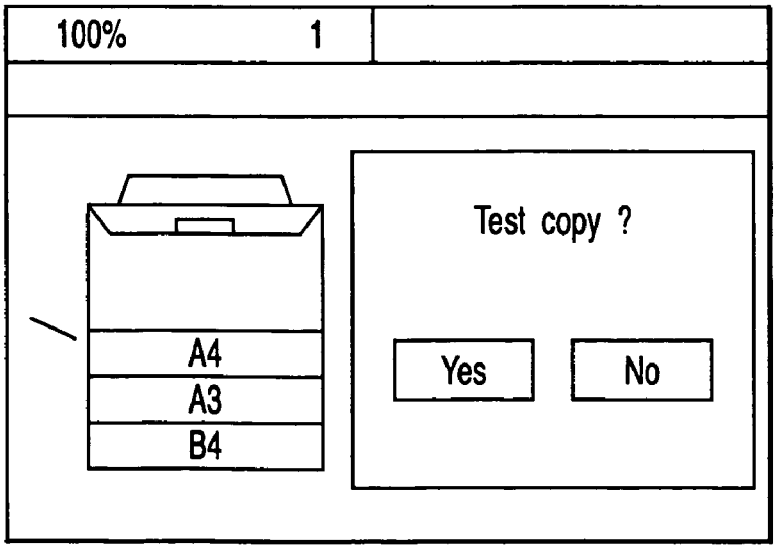

Subsequently, in an operation screen which displays a sheet size as shown in FIG. 6B, an arbitrary cassette (displaying the sheet size) (the type and the size of the sheet are changed) is selected. When a test copy is designated from the test copy display, as shown in FIG. 6C, "display for expediting starting of test copy" is displayed. In FIG. 6C, when a test copy start is designated from the display of "YES", the "regulating mode" is started. Incidentally, the screen display (button display) and the display contents of the operating panel 301 are, for example, stored in the memory 202. Though not described in detail, a GUI (graphical user interface) and the display memory may be sometimes provided for the special purpose to variously display and to input corresponding commands to the operating 301.

Incidentally, the presence or absence of the test copy (starting of the regulating mode) may be automatically started if the size and the type of the sheet housed in the arbitrary cassette are, for example, changed, in addition to the case that the regulating mode is started at arbitrary timing by the user as described above.

As has been described by FIG. 6C, the confirming screen of the presence or absence of the test copy is not always displayed (started), but may be displayed only at the service time, for example, by a service person.

The regulating mode may be automatically started at the time point when it reaches a predetermined number of times of forming the images. In this case, a program for starting the regulating mode and a method for regulating the regulating mode may be, for example, previously stored in the memory 202. Though not shown, the program may be started (updated) at an arbitrary timing via a network or the like from the outside.

The brand or the like of the sheet can be registered by the user from a sheet setting screen shown in, for example, in FIG. 6A. The data obtained by the test copy (regulating mode) is stored together with the number of times of forming the images (number of passing sheets) in the memory 202.

In the case of newly using sheet, a test copy (regulating mode) is newly needed, but in the case of the already registered sheet, the test copy is not required by calling the conditions stored in the memory 202.

For example, the optimum conditions in response to the sheet brand designated by the main controller 201 are read from the memory 202 by designating (inputting) the newly set sheet brand from the already registered brand group by the user, and the respective setting conditions are changed to the optimum conditions to match to the sheet. Incidentally, if the accumulation of the number of times of forming the images is, for example, remarkably increased so that the surface properties and the like of the respective rollers are changed and it is predicted that the conditions between the data input (stored) beforehand and the sheet brand are changed, the apparatus is started (regulated) based on the once stored data, and then the data are updated at an initial copying (image forming) time.

The test copy is normally based on a white sheet. However, since the rollers are contacted with the surface on which a toner image exists in the conveying roller after the image is formed (the fixing and discharging roller 27 contacted with the sheet passing the fixing unit 26, the discharging roller 29, the reversing section housing roller 42 in the reserving section 40, the housing unit discharge roller 44 or the reversing and conveying roller 46 and the like), the conveying speed is generally decelerated as compared with the white sheet.

Therefore, to measure (calculate) the speeds of these rollers, the rate of printing of the image (for example, a space factor of the image data except white (background) outputted from the CCD sensor 17 of the image reading section 10 or the number of image data of the exposure light outputted from the exposure unit 22 (numbers of image data/background) are obtained, and a regulated value is corrected by considering a specific sliding based on its result.

In case of the final sheet in each cassette, the friction of the surface with the opposite side to the surface contacted with the pickup roller (31) is different from the case except the final sheet. Therefore, when the moving time of the sheet between the sensors is obtained, an output of the empty sensor of the cassette supplying the corresponding sheet is monitored. When the final sheet is sensed, the regulating mode is canceled (or again performed except the final sheet).

Incidentally, it is noted that the sheet feeding and conveying conditions may be automatically regulated based on a life (accumulation of the number of times of forming the images) by a predetermined equation. In this case, since the change of the life is different according to the type (brand) of the sheet, an error might occur between the optimum conditions and the setting conditions as the sheet is passed according to the sheet.

Therefore, the test copy is periodically performed (regulating mode is started) to suppress the error to the minimum.

As described above, in the image forming apparatus according to the present invention, the sheet feeding and conveying conditions are regulated/set at each used sheet at sheet changing or arbitrary timing. Thus, the sheet can be fed and conveyed always under the optimum sheet feeding and conveying conditions irrespective of the type of the sheet, that is, the output medium. Therefore, reliability and durability of the sheet feeding and conveying are improved.

The jam rate at the sheet conveying time is improved. Further, the life of the sheet feeding roller is improved. Thus, the positional accuracy of the image outputted to the sheet is improved.

As described above, according to the present invention, the image forming apparatus which can stably output the image irrespective of the number of times of forming the images for the media for outputting of thicknesses and various types is obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

an image carrier which holds a developer image;

an output medium housing section which contains a medium of an arbitrary size and/or a type for fixing a developer image formed on the image carrier;

an output medium guide passage which is defined from the output of a medium housing section to the image carrier, and which guides the output medium;

a moving mechanism provided at an arbitrary position of the output medium guide passage to provide a thrust force which moves the output medium from the output medium housing section to the image carrier;

a speed detecting mechanism which detects the speed of the output medium moving in the output medium guide passage; and a speed changing mechanism which changes a pressure provided for the output medium from the moving mechanism when the change of the speed of the output medium is detected by the speed detecting mechanism to change the speed by which the output medium is moved when an instruction to perform a regulating mode is given the regulating mode including at least a test copy mode in which a medium is permitted to be conveyed in the output medium guide passage to achieve the change of the speed of the output medium by the speed changing mechanism, and the pressure provided for the output medium is changed based on a result of detection by the speed detecting mechanism.

2. The image forming apparatus according to claim 1, further comprising:

a memory unit which holds a condition that the pressure provided for the output medium from the moving mechanism is changed by the speed changing mechanism.

3. The image forming apparatus according to claim 2, wherein the condition that the pressure provided for the output medium from the moving mechanism is changed by the speed changing mechanism is preset at each size and/or a type of the output medium, and stored in the memory unit.

4. The image forming apparatus according to claim 1, wherein a regulating mode in which the pressure provided for the output medium from the moving mechanism is changeable by the speed changing mechanism is executable.

5. An image forming apparatus, comprising:

a medium conveying mechanism which includes at least one of roller members which is rotated by a motor member, and which conveys a medium to be transferred;

a medium speed detecting unit which detects the conveying speed of the medium to be transferred, and a pressure changing unit which changes the pressure provided for the medium to be transferred by the medium conveying mechanism in response to a difference from a predetermined speed that the medium to be transferred is conveyed to fall within a predetermined range if a difference between the speed of the medium to be transferred detected by the medium speed detecting unit and a predetermined speed that the medium to be transferred is conveyed is larger than a predetermined value when an instruction to perform a regulating mode is given, the regulating mode including at least a test copy mode in which a medium is permitted to be conveyed in the output medium guide passage to achieve the change of the speed of the output medium by the speed changing unit, and the pressure provided for the output medium is changed based on a result of detection by the speed detecting unit.

6. The image forming apparatus according to claim 5, wherein the pressure changing unit changes the position of the one of the roller members of the medium conveying mechanism according to a moving time of the medium to be transferred moved at an arbitrary distance.

7. The image forming apparatus according to claim 5, wherein the medium conveying mechanism includes first and second rollers contacted with front and rear surfaces of the medium to be transferred, and the pressure provided by at least one of first and second structures for another structure is changed according to the other is changed according to the moving time that the medium to be transferred is moved at an arbitrary distance.

8. The image forming apparatus according to claim 6, wherein a condition that the pressure provided for the medium to be transferred by the medium conveying mechanism is changed is preset at each size and/or type of the medium to be transferred.

9. The image forming apparatus according to claim 6, further comprising:

a memory unit which holds a condition that the pressure provided for the medium to be transferred by the medium conveying mechanism is changed.

10. The image forming apparatus according to claim 7, wherein a condition that the pressure provided for the medium to be transferred by the medium conveying mechanism is changed is preset at each size and/or type of the medium to be transferred.

11. The image forming apparatus according to claim 10, further comprising:

a memory unit which holds a condition that the pressure provided for the medium to be transferred by the medium conveying mechanism is changed.

12. A medium conveying method comprising:

feeding an output medium for supporting a developer image developed by developing means to a transfer position to which the developer image is transferred to the output medium, detecting the time for conveying the output medium between housing means and the transfer position, obtaining a regulating amount that a pressurizing force supplied to the output medium is regulated in a feeding mechanism for feeding the output medium to the transfer position based on the detected result, and regulating the pressurizing force to be supplied for the output medium from the feeding mechanism according to the obtained regulating amount when an instruction to perform a regulating mode is given, the regulating mode including at least a test copy mode in which a medium is permitted to be conveyed in the feeding mechanism to achieve the change of the pressurizing force, and the pressure provided for the output medium is changed based on a result of detection by the speed detecting mechanism, and the pressuring force is changed based on a result of the detecting the time for conveying the output medium.

13. The medium conveying method according to claim 12, wherein a condition that the pressure provided for the medium to be transferred by the medium-to-be-transferred conveying mechanism is changed is preset at each size and/or type of the medium to be transferred.

14. The image forming apparatus according to claim 1, further comprising an operating button which inputs a signal for setting the test copy mode.

15. The image forming apparatus according to claim 5, further comprising an operating button which inputs a signal for setting the test copy mode.

* * * * *